US012318671B2

(12) United States Patent
Fan

(10) Patent No.: US 12,318,671 B2
(45) Date of Patent: Jun. 3, 2025

(54) GOLF PUTTING PRACTICE DEVICE

(71) Applicant: Eagle Fan, Chu-Pei (TW)

(72) Inventor: Eagle Fan, Chu-Pei (TW)

( * ) Notice: Subject to any disclaimer, the term of this patent is extended or adjusted under 35 U.S.C. 154(b) by 771 days.

(21) Appl. No.: 17/680,783

(22) Filed: Feb. 25, 2022

(65) Prior Publication Data

US 2023/0271070 A1 Aug. 31, 2023

(51) Int. Cl.
*A63B 63/06* (2006.01)
*A63B 69/36* (2006.01)

(52) U.S. Cl.
CPC ..... *A63B 63/06* (2013.01); *A63B 69/3676* (2013.01)

(58) Field of Classification Search
CPC . A63B 63/06; A63B 69/3676; A63B 71/0036; A63B 57/00; A63B 45/02; A63B 63/00; A63B 57/30; A63B 63/08
See application file for complete search history.

(56) References Cited

U.S. PATENT DOCUMENTS 3,791,653 A * 2/1974 Yamada ..... A63B 69/3676 273/127 D
5,181,721 A * 1/1993 Halliburton ..... A63B 63/00 273/378
5,904,625 A * 5/1999 Shillingburg ..... A63B 69/3676 473/241
2004/0018884 A1* 1/2004 Kaplan ..... A63B 69/36 473/195
2012/0202613 A1* 8/2012 Finch ..... A63B 69/3667 473/257
2016/0114235 A1* 4/2016 Gilmore ..... A63B 63/00 473/175

FOREIGN PATENT DOCUMENTS

WO WO-2021035046 A1 * 2/2021 ..... A63B 63/004

* cited by examiner

*Primary Examiner* — Michael D Dennis

(57) ABSTRACT

A golf putting practice device is provided, including: a box, two supporting feet and a marking piece, tops of the two supporting feet are pivotally connected to the bottom of the box, folded and pressed to the bottom surface of the box when not in use, and the marking piece is installed on the box and partially exposed below the box; when the two supporting feet are unfolded and flip open to stand on the ground, the two supporting feet and the box form a goal, and the marking piece is located between the two supporting feet for aiming and putting practice.

8 Claims, 5 Drawing Sheets

GOLF PUTTING PRACTICE DEVICE

BACKGROUND OF THE INVENTION

1. Field of the Invention

The present invention relates generally to a golf putting practice device, and more particularly, to a structure with a goal provided for practicing golf putting skill.

2. The Prior Arts

Generally, shots in golf can be divided into two broad categories. The first category is a long-swing shot that requires a driver, a wood club, an iron club, etc., mainly on the fairway. The second category is the light shot near or on the green, which requires a short putt with high concentration. Especially the putting action on the green, although the distance is short, directly affects the score, and is an even more important factor affecting the result of the entire game. Therefore, every golfer will often practice systematically and regularly to maintain the consistent level of putting force and accuracy.

The most important thing in putting technique is the ability to correctly push the golf ball to a predetermined location. Usually, a lot of practice is required to maintain the consistency of the swing posture, learn to control the force of the putter, and then control the rolling speed and direction of the golf ball, so as to easily hit the ball to the target point anytime and anywhere, as well as develop firm self-confidence, and avoid the muscles becoming too stiff due to tension during the game, resulting in mistakes. For this reason, simple and effective devices and facilities are needed, which can be easily used at any time, so that practitioners can carry out the putting exercises at any time, whether in the indoor driving range or on the outdoor grass, and focus on training the ability to adapt to the actual grass environment, thereby improving the accuracy of the putting. Therefore, the inventor devised the disclosed golf putting practice device.

SUMMARY OF THE INVENTION

A primary objective of the present invention is to provide a golf putting practice device, which can form a goal for putting practice after the structure is unfolded, for easy and rapid deployment on indoor artificial turf or outdoor grass for putter practice, so as to steadily improve hitting skills.

A further objective of the present invention is to provide a golf putting practice device that can provide a variety of different practice patterns, and the use of a marking piece provides the goal of aiming, simulating the position of the club or the width of the hole, etc., so that the practice is more fun and practical.

To achieve the aforementioned objectives, the golf putting practice device of the present invention includes: a box, two supporting feet and a marking piece, tops of the two supporting feet are pivotally connected to the bottom of the box, folded and pressed to the bottom surface of the box when not in use, and the marking piece is installed on the box and partially exposed below the box; when the two supporting feet are unfolded and flip open to stand on the ground, the two supporting feet and the box form a goal, and the marking piece is located between the two supporting feet.

In a preferred embodiment, the box further comprises an openable upper cover.

In a preferred embodiment, the positions where the two supporting feet are pivotally connected to the bottom of the box are on both sides of the long side, and when folded, the two supporting feet are pulled towards each other and pressed against the bottom of the box.

In a preferred embodiment, a box bottom plate is disposed in the box, and the box bottom plate is disposed with at least one hole, the marking piece is a rod with a T-shaped or tapered cross-section, and the hole has a diameter smaller than the maximum outer diameter of the marking piece, and the marking piece is inserted into the hole from top to bottom, so that the marking piece is partially exposed below the box.

In a preferred embodiment, the box bottom plate has a row of holes arranged side by side, and the holes are distributed between the pivot joints of the two support feet and the box.

In a preferred embodiment, the marking piece is a golf tee.

In a preferred embodiment, the marking piece is at least one door piece, and the door piece is pivotally connected to the bottom of the box.

In a preferred embodiment, the bottom of the box is disposed with at least one shaft, the shaft is located between the two pivots joints of the supporting feet on the box, and the door piece is pivoted to the shaft and is rotatable, and the position of the door piece on the shaft is adjustable.

In a preferred embodiment, the number of the door pieces is two.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

The technical solutions of the present invention will be described clearly and completely below in conjunction with the specific embodiments and the accompanying drawings. It should be noted that when an element is referred to as being "mounted or fixed to" another element, it means that the element can be directly on the other element or an intervening element may also be present. When an element is referred to as being "connected" to another element, it means that the element can be directly connected to the other element or intervening elements may also be present. In the illustrated embodiment, the directions indicated up, down, left, right, front and back, etc. are relative, and are used to explain that the structures and movements of the various components in this case are relative. These representations are appropriate when the components are in the positions shown in the figures. However, if the description of the positions of elements changes, it is believed that these representations will change accordingly.

Unless otherwise defined, all technical and scientific terms used herein have the same meaning as commonly understood by one of ordinary skill in the art of the present invention. The terminology used herein is for the purpose of describing particular embodiments only and is not intended to limit the present invention. As used herein, the term "and/or" includes any and all combinations of one or more of the associated listed items.

Figure 1:
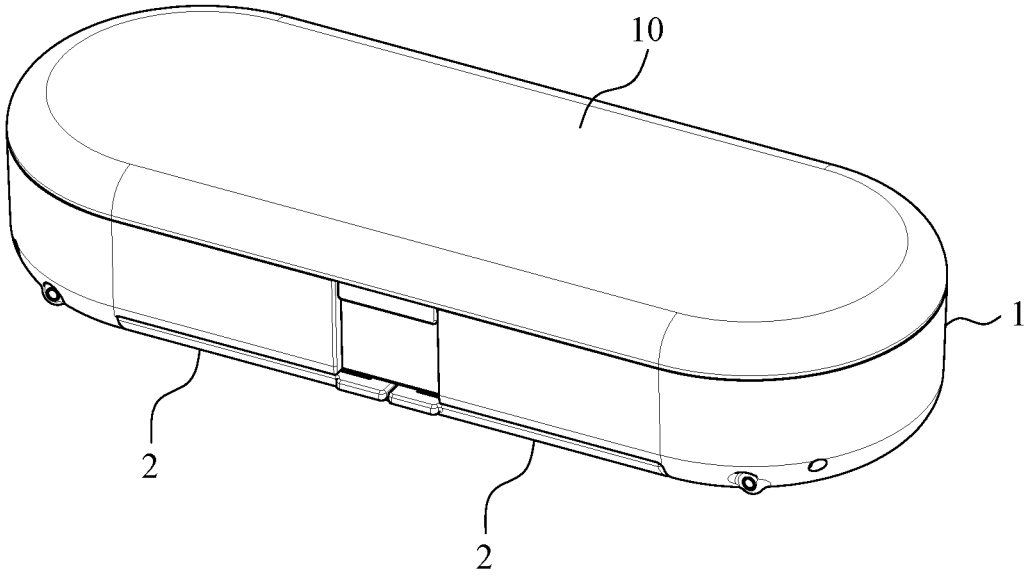
FIG. 1 is a perspective view of a golf putting practice device of the present invention.
Figure 2:
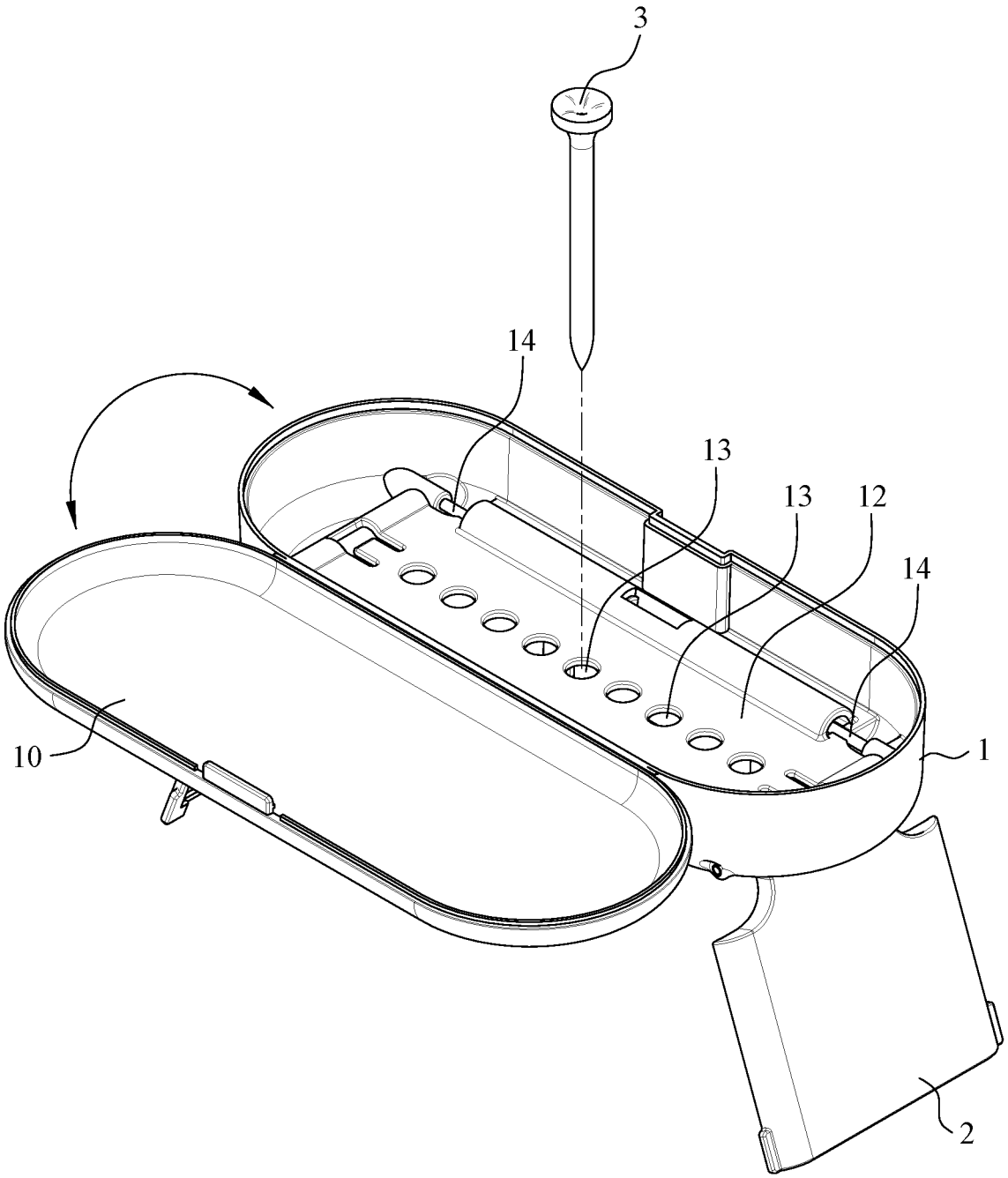
FIG. 2 is an exploded view of a golf putting practice device of the present invention.
Figure 3:
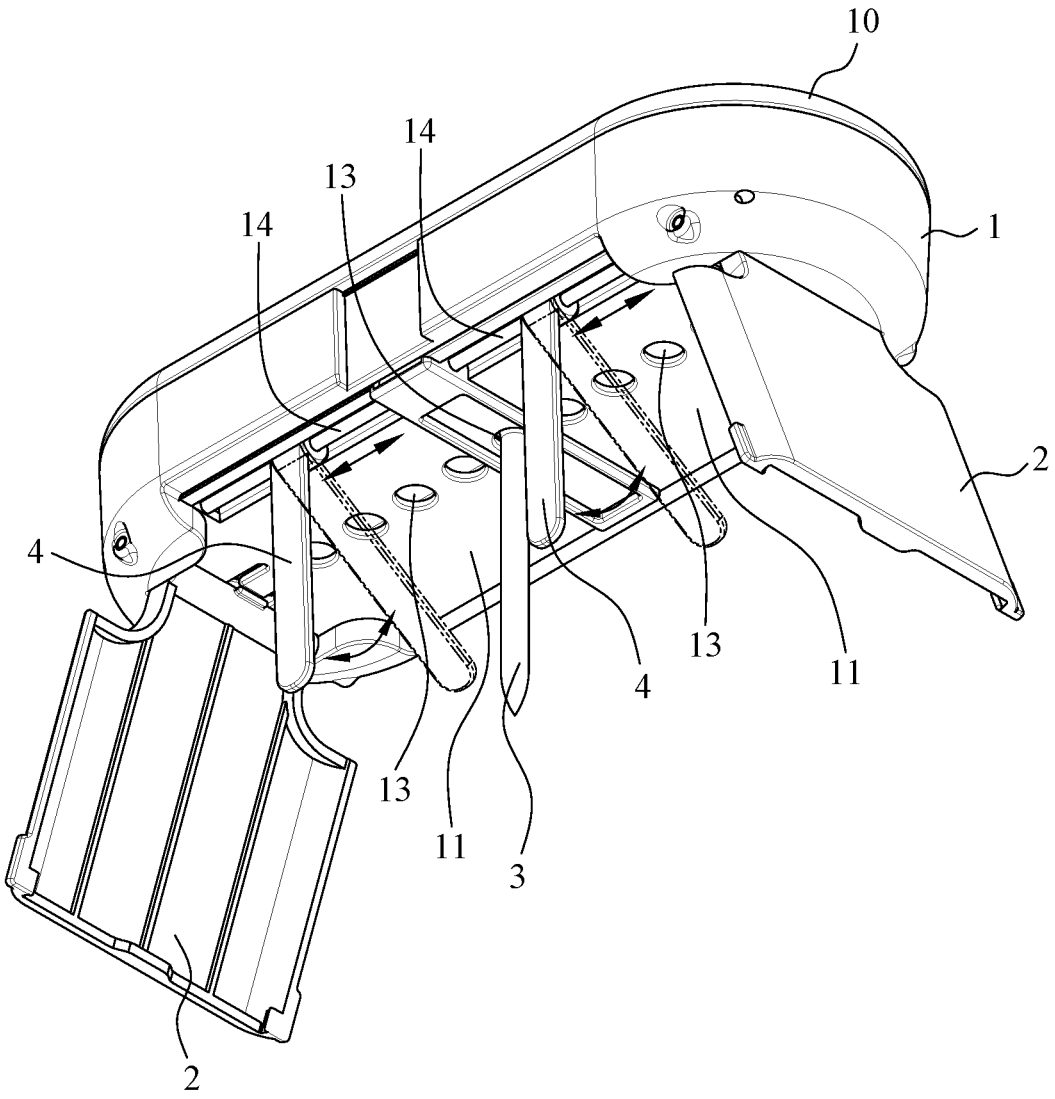
FIG. 3 is a perspective view of an in-use state with the two supporting feet of the golf putting practice device of the present invention pulled down.

As shown in FIG. 1, FIG. 2 and FIG. 3, the golf putting practice device of the present invention includes a box 1, two supporting feet 2, and a marking piece, and in the present embodiment, the marking piece can be at least one of the golf tees 3 or door pieces 4. The tops of the two supporting feet 2 are pivotally connected to the bottom of the box 1, and the two supporting feet 2 can be folded and pressed to the bottom surface of the box 1 when not in use, as shown in FIG. 1. The marking piece can be installed on the box 1 and exposed below the box 1. When the two supporting feet 2 are pulled down, i.e., unfolded as shown in FIG. 2, the two supporting feet 2 will stand on the ground and form a goal with the box 1. The marking piece such as a golf tack 3 or a door piece 4 is located between the two supporting feet 2 for aiming and practicing the putter. As such, the supporting feet 2 can be folded, and the box 1 is small in size and convenient to carry after folding.

Figure 4:
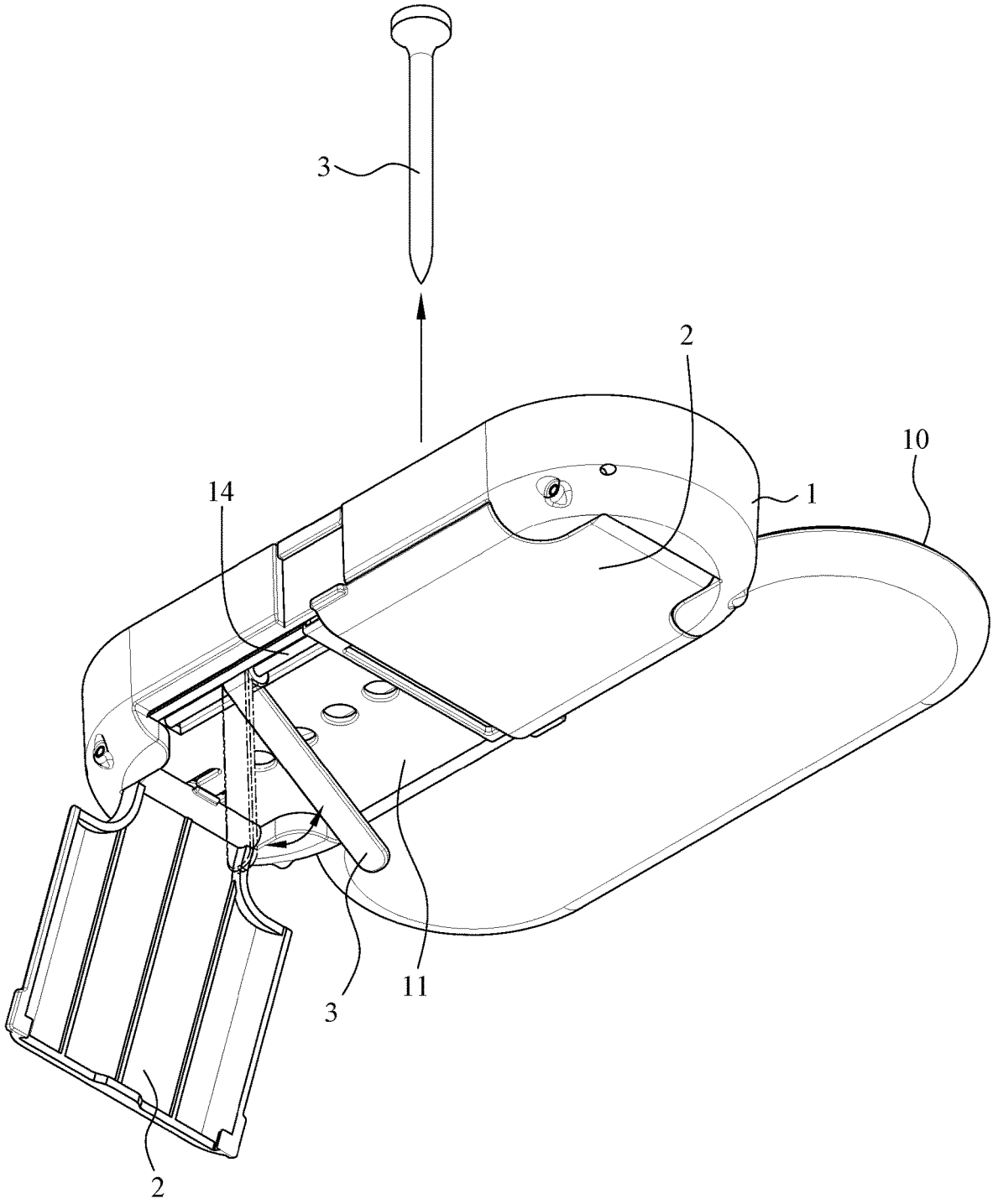
FIG. 4 is a perspective view of the supporting feet of the golf putting practice device of the present invention pulled toward each other and ready to be folded.

The following is a detailed description of each component with reference to FIG. 3 and FIG. 4:

The box 1 is a hollow elongated box with an upper cover 10 for opening or closing. The upper cover 10 and the box 1 can be separable, for example, with matching shapes, and can be butted together when not in use, but the present invention is not limited to herein. In the present embodiment, the upper cover 10 is made of soft material to couple with the box 1 to facilitate opening or closing. The box 1 is used for placing items commonly used in golf practice, such as ball marks or golf tees for practice golf.

The two supporting feet 2 are pivotally connected to the bottom of the box 1 at the top, and the pivot joints are on both sides of the long side of the bottom of the box 1. The opening angle of the supporting feet 2 is not more than 120 degrees, so as to facilitate subsequent standing. The bottom surface of the box 1 is further formed with a partially concave configuration area 11. A part of the configuration area 11 is shaped to fit the supporting feet 2. After the two supporting feet 2 are folded towards the middle of the box 1, the configuration area 11 is closed. As such, the supporting feet 2 match the shape of the box 1, so that the entirety of the box is more esthetical and does not occupy much space after folding. In addition, after the supporting feet 2 are folded, the configuration area 11 still has a gap in the interior for accommodating the door piece 4.

The marking piece is used as the aiming target of the push rod practice, and when the supporting foot 2 stands on the ground, the marking piece must be partially exposed below the box 1 and between the two supporting feet 2 for aiming. In the present embodiment, the marking piece can be at least one of the golf tees 3 or the door pieces 4, or both, which will be described in detail below.

As shown in FIG. 2, the box 1 has a box bottom plate 12, and the box bottom plate 12 has at least one hole 13. The holes 13 are distributed between the pivot joints of the two supporting feet 2 and the box 1. In the present embodiment, the marking piece is rod with a T-shaped or tapered cross-section. For example, the marking piece is the golf tee 3. The diameter of the hole 13 is smaller than the maximum diameter of the golf tee 3. When the golf tee 3 is inserted into the hole 13 from top, a part of the golf tee 3 will be exposed below the box 1. In the present embodiment, for the convenience of use, the golf tee 3 is directly used as the marking piece. Of course, the user can also use other similar items instead, for example, a special T-shaped or tapered rod is used as the marking piece.

The door piece 4 is pivotally connected to the bottom of the box 1. In the present embodiment, at least one shaft 14 is provided at the bottom of the box 1, and the shaft 14 is located between the two pivot joints of the two supporting feet 2 and the box 1. The door piece 4 has a diameter larger than that of the shaft 14 and is loosely fitted, so the door piece 4 can rotate freely, and the position of the door piece 4 can also be easily adjusted on the shaft 14. When the ball hits the door piece 4 during practice, the door piece 4 can rotate around the shaft 14, which increases the fun of practice. In addition, in the present embodiment, the number of the door pieces 4 is two, and the distance between the two door pieces 4 can be adjusted to simulate the golf hole width on the green for aiming during putting practice.

As shown in FIG. 4, when not in use, the golf tee 3 is removed from the hole 13 and placed in the box 1, then the two supporting feet 2 are folded toward the middle and towards each other. At this point, the door piece 4 will also rotate to be located in the configuration 11, and will be accommodated in the supporting feet 2 when pressed to the bottom surface of the box 1.

Figure 5:
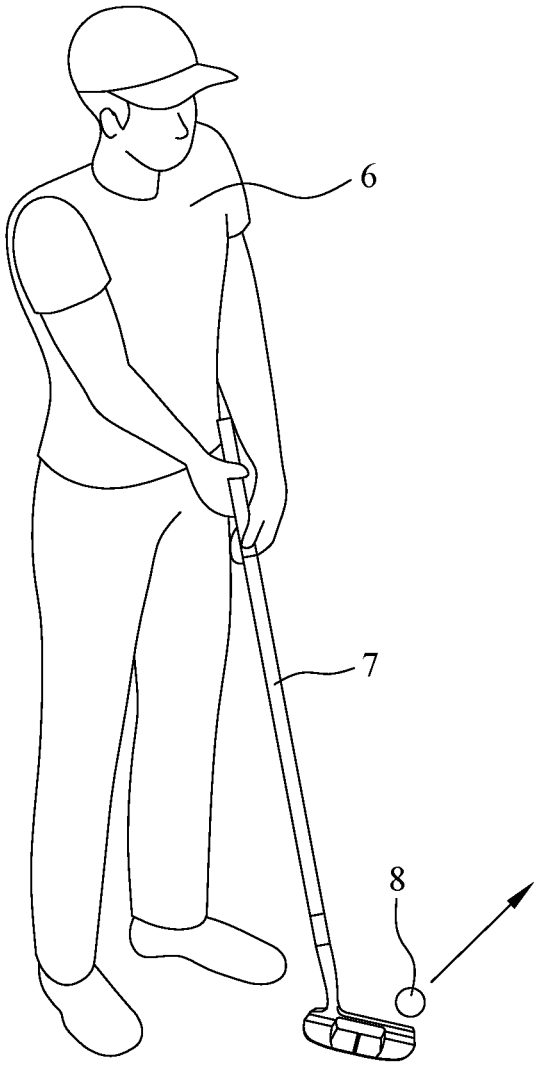
FIG. 5 is a schematic view of the in-use state of the golf putting practice device of the present invention.
Figure 5:
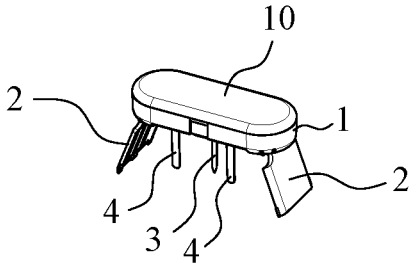

As shown in FIG. 5, the golf putting practice device of the present invention, by standing on the grass with two of the supporting feet 2, will form a goal for the practitioner 6 to use a putter 7 to push a golf ball 8 to hit the goal. By inserting the golf tee 3 into one of the holes 13 in the box 1 from top, the door piece 4 is naturally sag and vertical under the influence of gravity, and the golf tee 3 is exposed in-between, which can simulate golf tee position of the hole for aiming. The distance between the two door pieces 4 is adjusted to correspond to the width of the golf hole, so that the practitioner 6 can perform the putting practice. Apparently, the practitioner 6 can choose to remove the golf tee 3 and use only two of the door pieces 4 to simulate a golf hole, or insert a plurality of the golf tees 3 to form several aiming points for more accurate simulation of various states. Herein is only a schematic view of some practice methods of the present invention for understanding the use of the present invention, and does not limit the scope of the present invention.

In summary, the golf putting practice device of the present invention includes a box 1 and two supporting feet 2, which can be folded into a box when not in use, and the accessories for practice can also be placed in the box 1 for convenient storage and carrying. For use in the grass or the court, the supporting feet 2 are unfolded to stand on the ground to form a goal, which is convenient for putting practice and brings great convenience to the user. In addition, marking pieces such as golf tees 3 and door pieces 4 are used to provide a variety of different practice usage patterns, thereby improving the putting technique.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A golf putting practice device, comprising: a box, two supporting feet and a marking piece; tops of the two supporting feet being pivotally connected to bottom of the box, folded and pressed to a bottom surface of the box when not in use; and the marking piece being installed on the box and partially exposed below the box; when the two supporting feet are unfolded and flipped open to stand on ground, the two supporting feet and the box forming a goal, and the marking piece being located between the two supporting feet; wherein a box bottom plate is disposed in the box, and the box bottom plate has at least one hole, the marking piece is a rod with a T-shaped or tapered cross-section, and the at least one hole has a diameter smaller than a maximum outer diameter of the marking piece, and the marking piece is inserted into one of the at least one hole from top to bottom so that the marking piece is partially exposed below the box.

2. The golf putting practice device according to claim 1, wherein the box further comprises an openable upper cover.

3. The golf putting practice device according to claim 1, wherein positions where the two supporting feet are pivotally connected to the bottom of the box are on both sides of a long side, and when folded, the two supporting feet are pulled towards each other and pressed against the bottom of the box.

4. The golf putting practice device according to claim 1, wherein the box bottom plate has a row of holes arranged side by side, and the holes are distributed between pivot joints of the two support feet and the box.

5. The golf putting practice device according to claim 1, wherein the marking piece is a golf tee.

6. The golf putting practice device according to claim 1, wherein the marking piece comprises at least one door piece and the at least one door piece is pivotally connected to the bottom of the box.

7. The golf putting practice device according to claim 6, wherein the bottom of the box is disposed with at least one shaft, the at least one shaft is located between two pivots joints of the supporting feet on the box, and the at least one door piece is pivoted to the at least one shaft and is rotatable, and a position of the at least one door piece on the at least one shaft is adjustable.

8. The golf putting practice device according to claim 6, wherein two door pieces are provided.

* * * * *